US010266778B2

(12) United States Patent
Gao et al.

(10) Patent No.: US 10,266,778 B2
(45) Date of Patent: Apr. 23, 2019

(54) METHOD FOR UPGRADING FLUID CATALYTIC CRACKING GASOLINE

(71) Applicant: CHINA UNIVERSITY OF PETROLEUM—BEIJING, Beijing (CN)

(72) Inventors: Jinsen Gao, Beijing (CN); Liang Zhao, Beijing (CN); Chunming Xu, Beijing (CN); Tianzhen Hao, Beijing (CN); Xiaona Han, Beijing (CN)

(73) Assignee: CHINA UNIVERSITY OF PETROLEUM-BEIJING, Beijing (CN)

( * ) Notice: Subject to any disclaimer, the term of this patent is extended or adjusted under 35 U.S.C. 154(b) by 16 days.

(21) Appl. No.: 14/940,027

(22) Filed: Nov. 12, 2015

(65) Prior Publication Data

US 2016/0222303 A1 Aug. 4, 2016

Related U.S. Application Data

(63) Continuation of application No. PCT/CN2015/075888, filed on Apr. 3, 2015.

(30) Foreign Application Priority Data

Feb. 4, 2015 (CN) ..... 2015 1 0058274
Feb. 4, 2015 (CN) ..... 2015 1 0058454
Feb. 4, 2015 (CN) ..... 2015 1 0059630

(51) Int. Cl.
*C10G 67/02* (2006.01)
*C10G 67/06* (2006.01)
(Continued)

(52) U.S. Cl.
CPC ..... *C10G 67/02* (2013.01); *C10G 21/16* (2013.01); *C10G 21/27* (2013.01); *C10G 25/003* (2013.01);
(Continued)

(58) Field of Classification Search
CPC ..... C10G 21/16; C10G 21/27; C10G 25/003; C10G 45/08; C10G 45/64; C10G 45/68;
(Continued)

(56) References Cited

U.S. PATENT DOCUMENTS 2,886,610 A * 5/1959 Georgian ..... C10G 21/02 203/55
3,759,821 A * 9/1973 Brennan ..... C10G 35/095 208/138
(Continued)

FOREIGN PATENT DOCUMENTS

CN 1160746 A 10/1997
CN 1464033 A 12/2003
(Continued)

OTHER PUBLICATIONS

Chinese First Examination Report of corresponding China patent application No. 201510058274.0, dated Sep. 15, 2015.
(Continued)

*Primary Examiner* — Randy Boyer
*Assistant Examiner* — Brandi M Doyle
(74) *Attorney, Agent, or Firm* — J.C. Patents

(57) ABSTRACT

A method for upgrading fluid catalytic cracking gasoline includes the following steps: cutting fluid catalytic cracking gasoline into light, medium, and heavy gasoline fractions; subjecting the medium gasoline fraction to an aromatization/hydroisomerization reaction in the presence of a catalyst to obtain a desulfurized medium gasoline fraction; and blending the light gasoline fraction, the desulfurized medium gasoline fraction and the heavy gasoline fraction to obtain upgraded gasoline; where, a cutting temperature of the light and the medium gasoline fractions is 35-60° C., and a cutting temperature of the medium and the heavy gasoline fractions is 70-160° C. The method according to the present invention
(Continued)

not only can realize deep desulfurization of fluid catalytic cracking gasoline, but also can improve octane number significantly.

13 Claims, 4 Drawing Sheets

(51) Int. Cl.

| | |
|---|---|
| ***C10G 67/00*** | (2006.01) |
| ***C10L 1/06*** | (2006.01) |
| ***C10G 21/16*** | (2006.01) |
| ***C10G 21/27*** | (2006.01) |
| ***C10G 25/00*** | (2006.01) |
| ***C10G 45/08*** | (2006.01) |
| ***C10G 45/64*** | (2006.01) |
| ***C10G 45/68*** | (2006.01) |
| ***C10G 67/04*** | (2006.01) |
| ***C10G 69/00*** | (2006.01) |
| ***C10G 69/04*** | (2006.01) |

(52) U.S. Cl.
CPC ..... *C10G 45/08* (2013.01); *C10G 45/64* (2013.01); *C10G 45/68* (2013.01); *C10G 67/00* (2013.01); *C10G 67/04* (2013.01); *C10G 67/06* (2013.01); *C10G 69/00* (2013.01); *C10G 69/04* (2013.01); *C10L 1/06* (2013.01); *C10L 2200/0423* (2013.01); *C10L 2270/023* (2013.01); *C10L 2290/24* (2013.01); *C10L 2290/543* (2013.01)

(58) Field of Classification Search
CPC ..... C10G 65/00; C10G 65/046; C10G 65/08; C10G 67/00; C10G 67/02; C10G 67/04; C10G 67/06; C10G 67/16; C10G 69/00; C10G 69/04
See application file for complete search history.

(56) References Cited

U.S. PATENT DOCUMENTS

| | | | | |
|---|---|---|---|---|
| 5,294,328 | A | 3/1994 | Schmidt et al. | 208/66 |
| 5,413,697 | A * | 5/1995 | Fletcher | C10G 35/095 208/211 |
| 6,623,627 | B1 * | 9/2003 | Zhou | C10G 67/16 208/208 R |
| 7,005,058 | B1 * | 2/2006 | Towler | C10G 45/72 208/211 |
| 2005/0173297 | A1 * | 8/2005 | Toida | B01J 20/165 208/14 |
| 2005/0258077 | A1 | 11/2005 | Landau et al. | 208/244 |
| 2010/0236978 | A1 * | 9/2010 | Fan | C10G 45/08 208/60 |

FOREIGN PATENT DOCUMENTS

| | | | |
|---|---|---|---|
| CN | 1611572 | A | 5/2005 |
| CN | 1735675 | A | 2/2006 |
| CN | 102051223 | A | 5/2011 |
| CN | 102764630 | A | 11/2012 |
| CN | 103555359 | A | 2/2014 |
| CN | 103805269 | A | 5/2014 |

OTHER PUBLICATIONS

Chinese First Examination Report of corresponding China patent application No. 201510058454.9, dated Oct. 8, 2015.
Chinese First Examination Report of corresponding China patent application No. 201510059630.0, dated Oct. 19, 2015.

* cited by examiner

METHOD FOR UPGRADING FLUID CATALYTIC CRACKING GASOLINE

CROSS-REFERENCE TO RELATED APPLICATIONS

This application is a continuation of International Application No. PCT/CN2015/075888, filed on Apr. 3, 2015, which claims the priority benefit of China Patent Applications No. 201510059630.0, filed on Feb. 4, 2015, No. 201510058454.9, filed on Feb. 4, 2015 and No. 201510058274.0, filed on Feb. 4, 2015. The contents of the above identified applications are incorporated herein by reference in their entireties.

FIELD OF TECHNOLOGY

The present invention relates to the technical field of petrochemicals and, in particular, to a method for upgrading fluid catalytic cracking gasoline (FCC gasoline).

BACKGROUND

Petroleum resources have constantly deteriorated and crude oil becomes more and more heavy in compositions, requirements for environmental protection are getting more and more strict, and new environmental regulations around the world have imposed more stringent requirements on gasoline quality. For instance, the National V Standard for motor gasoline which will be implemented by Jan. 1, 2017 will require olefins content to be below 24%, sulfur content to be below 10 ppm, and octane number to be above 93. Upgrading gasoline quality standard are mainly embodied in: reducing the olefins content and the sulfur content while increasing the octane number.

Currently, developed countries mainly target at improving "formulations" of the gasoline to meet a corresponding quality standard. They use various processes to manufacture gasoline, and then blend various types of gasoline. Generally, in the gasoline, fluid catalytic cracking gasoline containing olefins accounts for about less than ⅓, reformulated gasoline which contains aromatics but frees of olefins accounts for about more than ⅓, and other clean gasoline components subjected to alkylation, isomerization and etherification which contains neither aromatics nor olefins account for about ⅓. The sulfur content and the olefins content are low, and the octane number is high.

The fluid catalytic cracking gasoline is a major part of China's motor gasoline, which accounts for about 75% in a gasoline pool. Approximately 90% of olefins content and sulfur content in finished gasoline comes from the fluid catalytic cracking gasoline, resulting in that China's gasoline products are far from meeting new index requirements of sulfur content ≤10 ppm and olefins content ≤24%. In another aspect, currently, mainly 93# gasoline is used China, however, as the manufacturing technology of domestic automotive industry continuously improves and domestic retention quantity of imported automobile unceasingly increases, there is an increasing demand for 95# gasoline or gasoline with higher octane number. Since the fluid catalytic cracking gasoline is limited by the process itself, octane number thereof is maintained primarily by large amounts of olefins, and RON is generally about 90, thus the octane number of the fluid catalytic cracking gasoline directly influences the octane level of the finished gasoline. Moreover, at present, a main process for removing sulfur and lowering olefins in fluid catalytic cracking gasoline is catalytic hydrogenation, which inevitably leading to large amounts of olefins being saturated, resulting in a greater loss of octane number, and seriously affecting economic returns of enterprises.

As crude oil becomes increasingly heavier in compositions, the catalytic cracking capacity of heavy oil is expanded constantly and environmental regulations become increasingly stringent, this problem mentioned above is more prominent, which is objectively forcing the petrochemical industry to research and develop new processes for upgrading the fluid catalytic cracking gasoline efficiently, especially an efficient upgrading process which can realize both deep desulfurization of the fluid catalytic cracking gasoline and improvement of the octane number.

Existing sulfur reduction techniques of the fluid catalytic cracking gasoline are mainly represented by S-zorb of Sinopec, RSDS of Sinopec Research Institute of Petroleum Processing and Prime-G+ of French. S-zorb is developed by U.S. Conocophillips Corporation, bought out and improved by Sinopec Group, and is used for desulfurization of full-range fluid catalytic cracking gasoline, the sulfur content of the full-range gasoline after desulfurization may be controlled to be below 10 ppm, and an octane number loss of the full-range gasoline is 1.0~2.0 units. RSDS is developed by Sinopec Research Institute of Petroleum Processing, this technique firstly cuts catalytic gasoline into light and heavy gasoline fractions, then the light gasoline fraction is subjected to sweetening by extraction, and the heavy gasoline fraction is subjected to selective hydrodesulfurization; when a product with sulfur content of less than 10 ppm is manufactured by this technique, the yield of light gasoline fraction is about 20%, most of the fractions requires hydrogenation, and an octane number loss of the full-range gasoline is between 3.0~40. Prime-G+ is developed by French Axens Corporation, which uses a technological process comprising full-range prehydrogenation, cutting of light and heavy gasoline and selective hydrodesulfurization of heavy gasoline fraction, and is characterized by reaction light sulfide with diolefins to form a sulfide with high boiling point during the full-range prehydrogenation process, where olefins is not saturated, and then light gasoline fraction with sulfur content less than 10 ppm and heavy gasoline fraction with high sulfur content are obtained by cutting of light and heavy gasoline, and the heavy gasoline fraction is subjected to hydrodesulfurization; this technique is the same as RSDS, although a part of light gasoline fraction with low sulfur content may not be subjected to hydrogenation, since light gasoline fraction with sulfur content less than 10 ppm have a low yield, most of the fractions requires hydrogenation, resulting in that the octane number loss of the full-range gasoline is also between 3.0~4.0.

CN1611572A discloses a catalytic conversion method for improving octane number of gasoline. This method enables heavy gasoline fraction having an initial boiling point greater than 100° C. to be contacted with a catalyst having a temperature lower than 700° C., and reacted in a condition where a temperature is 300~660° C., a pressure is 130~450 KPa, a weight hourly space velocity is 1~120 $h^{-1}$, a weight ratio of the catalyst to the gasoline fractions is 2~20, and a weight ratio of steam to the gasoline fractions is 0~0.1, and a reaction product is separated from a coked catalyst, where the coked catalyst is recycled by stripping and regeneration. Octane number of fluid catalytic cracking gasoline may be increased by 3~10 units by using the method provided in the present invention. This method follows a catalytic cracking mechanism of oil hydrocarbons, subjecting gasoline to a hydrogen transfer reaction and a cracking reaction, although octane number of the gasoline can be improved, the cutting of fractions need to be carried out firstly, and only the heavy gasoline fraction having the initial boiling point greater than 100° C. are collected for the reaction, thus there is a great loss of gasoline.

CN1160746A discloses a catalytic conversion method for improving octane number of low-grade gasoline. This method enables gasoline having low octane number to be contacted with a high temperature catalyst coming from a regenerator by injecting the gasoline into a riser reactor from an upstream of an inlet of a conventional catalytic cracking feedstock, and reacted in a condition where a reaction temperature is 600~730° C., a ratio of the catalyst to the gasoline is 6~180, and a weight hourly space velocity is 1~180 $h^{-1}$. This method may increase octane number of the gasoline, but all the gasoline having low octane number in the method is required to participate in the reaction, thus there is a great loss of gasoline.

CN103805269A proposes a method for deep hydrodesulfurization of catalytic gasoline, a clean gasoline product is obtained by subjecting light gasoline and medium gasoline fractions to alkali-free sweetening, then separating the light and the medium gasoline through a hydrogenation pre-fractionating tower, where the hydrogenation pre-fractionating tower is imported with hot diesel simultaneously; subjecting the separated medium gasoline and heavy gasoline to selective hydrogenation after blending them, and blending the resulted distillate oil with the light gasoline being subjected to alkali-free sweetening. Although this method can realize effective desulfurization and a degree of decrease of octane number is also alleviated to some extent, the octane number cannot be increased effectively, and there are considerable differences between the technological process of this method and that of the present invention.

In conclusion, generally, there are problems such as a large proportion of hydrogenation and a great loss of octane number when a current technique dealing with the deep desulfurization requirement of fluid catalytic cracking gasoline. Effects of some supporting processes for restoring octane number during hydrodesulfurization are not obvious either. There is a pressing demand on the market to develop a technique for deep desulfurization of fluid catalytic cracking gasoline, which has less loss of octane number or significant rise of octane number.

SUMMARY

In order to solve the above technical problems, the present invention provides a method for upgrading fluid catalytic cracking gasoline, which not only can deeply remove sulfide contained in fluid catalytic cracking gasoline to below 10 ppm, but also can significantly improve octane number of the fluid catalytic cracking gasoline by 1-3 units.

The objective of the present invention is achieved through the following technical solutions:

A method for upgrading fluid catalytic cracking gasoline, including the following steps:

cutting fluid catalytic cracking gasoline into light, medium, and heavy gasoline fractions;

subjecting the medium gasoline fraction to an aromatization/hydroisomerization reaction in the presence of a catalyst to obtain a desulfurized medium gasoline fraction; and blending the light gasoline fraction, the desulfurized medium gasoline fraction and the heavy gasoline fraction to obtain upgraded gasoline;

wherein, a cutting temperature of the light and the medium gasoline fractions is 35-60° C., and a cutting temperature of the medium and the heavy gasoline fractions is 70-160° C.

The term cutting in the present invention refers to segmenting the fluid catalytic cracking gasoline into light, medium and heavy gasoline fractions according to a boiling range from low to high, and controlling the boiling range of the medium gasoline fraction from 35-50° C. to 130-160° C.

According to the upgrading method of the present invention, the fluid catalytic cracking gasoline (FCC gasoline) is subjected to fraction cutting firstly, by controlling the cutting temperature, the collected light gasoline fraction is fluid catalytic cracking gasoline rich in olefins and with high octane number, the medium gasoline fraction is fluid catalytic cracking gasoline with moderate content of olefins and aromatics and with lowest octane number, and the heavy gasoline fraction is fluid catalytic cracking gasoline with relatively low content of olefins but with relatively high content of aromatics and high octane number. Furthermore, in the present invention, the medium gasoline fraction with lowest octane number is subjected to an aromatization/hydroisomerization reaction, the resultant is then blended with other gasoline fractions, through this blending, FCC gasoline with significant increase of octane number is obtained.

In the implementations of the present invention, according to a situation of the FCC gasoline, a boiling range of the medium gasoline fraction may be determined with overall consideration of handling capacities and effects for gasoline feedstock. The inventors found that, the medium gasoline fraction having a boiling range of 40-160° C. accounts for about 40 m % of the fluid catalytic cracking gasoline, which is basically the part with the lowest octane number, and has an RON below 80, a minority part of the medium gasoline fraction even has an RON below 70, thus the medium gasoline fraction may be controlled as a gasoline fraction having the boiling range of 40-160° C., preferably a gasoline fraction having a boiling range of 40-150° C. Obviously, the longer the boiling range, the more the amount of the fraction can be collected, and the greater the amount of oil that needs to undergo the aromatization/hydroisomerization reaction is, thus, the cutting temperature of the medium and the heavy gasoline fractions may be further set to 70-130° C.

In a specific implementation of the present invention, the catalyst used for the aromatization/hydroisomerization reaction of the medium gasoline fraction may be a catalyst commonly used for the aromatization/hydroisomerization reaction for processing the FCC gasoline. In an implementation, the catalyst used for the aromatization/hydroisomerization reaction is obtained by using a zeolite and a metallic oxide as a composite carrier to load an active metal component, where the active metal is zinc and/or gallium.

More specifically, the zeolite may be one or more of an MFI type zeolite, an MCM type zeolite and an LTL type zeolite, and the metallic oxide is aluminum oxide, where the MFI type zeolite may be a zeolite such as a ZSM-5, an HZSM-5 and the like, the MCM type zeolite may be a zeolite such as an MCM-41, and the LTL type zeolite may be an L type zeolite.

Furthermore, in the catalyst used for the aromatization/hydroisomerization reaction, a weight ratio of the zeolite to the metallic oxide is 1:(0.2-0.5), and the active metal has a loading capacity of 0.5-3% on the composite carrier. The catalyst may be obtained by immersing the composite carrier with a soluble salt solution of the active metal, and calcinating the impregnated material subsequent to drying; the immersion may be incipient wetness impregnation.

Furthermore, a reaction temperature of the aromatization/hydroisomerization reaction is 260-400° C., a reaction pressure is 0.8-2.0 MPa, a volume ratio of hydrogen to oil is 200-800:1 and a weight hourly space velocity is 1.0-6.0 $h^{-1}$. Moreover, the aromatization/hydroisomerization reaction according to the present invention may be carried out by using a fixed bed reactor, thereby facilitating the control of the reaction process and improving the efficiency and lifespan of the catalyst.

The method for upgrading fluid catalytic cracking gasoline according to the present invention, before the medium gasoline fraction is subjected to the aromatization/hydroisomerization reaction, the medium gasoline fraction may also be subjected to desulfurization firstly to obtain a first desulfurized medium gasoline fraction, and then the first desulfurized medium gasoline fraction is subjected to the aromatization/hydroisomerization reaction in the presence of the catalyst to obtain a second desulfurized medium gasoline fraction, and then the light gasoline fraction is blended with the second desulfurized medium gasoline fraction and the heavy gasoline fraction to obtain upgraded gasoline.

In an implementation, the desulfurization of the medium gasoline fraction is solvent extraction desulfurization, and the solvent extraction desulfurization may be performed by using a technique known in the art, and there is no strict limitation. For instance, a method for solvent extraction desulfurization of gasoline fractions disclosed in a patent with a publication number of CN103555359A may be used for processing the medium gasoline fraction, which specifically includes steps: introducing the medium gasoline fraction from a middle lower part of an extraction tower and a solvent from a top of the extraction tower, injecting C5 paraffin from a backflow device at the bottom of the extraction tower, controlling a temperature at the top of the extraction tower between 55-100° C., a temperature at the bottom of the extraction tower between 40-80° C., and a pressure at the top of the extraction tower between 0.2-0.7 MPa, controlling a feed ratio of the solvent to the medium gasoline fraction between 1.0-5.0, and controlling a feed ratio of the C5 paraffin to the medium gasoline fraction at 0.1-0.5. A reason for adding the C5 paraffin to the solvent extraction desulfurization process is to increase separation efficiency. In an implementation of the present invention, the C5 paraffin may be selected from one or both of n-pentane and isopentane.

According to the described manner, the medium gasoline fraction is subjected to solvent extraction desulfurization firstly so as to separate desulfurized medium gasoline fraction and residual oil, and the desulfurized medium gasoline fraction is subjected to the aromatization/hydroisomerization reaction subsequently, which not only reduces the amount of the fraction that needs to be processed in the aromatization/hydroisomerization reaction, but also helps to improve the efficiency of the aromatization/hydroisomerization reaction. Furthermore, the residual oil may be blended with resultants of the aromatization/hydroisomerization reaction, the light gasoline fraction and the heavy gasoline fraction to obtain the upgraded gasoline.

For the desulfurization performed by using solvent extraction, the selection of solvent and separation operations and steps all may be determined by persons skilled in the art based on their basic knowledge and skills. For instance, the extraction may be completed in an extraction tower, and the solvent may be selected from one or more of diethylene glycol, triethylene glycol, tetraethylene glycol, dimethyl sulfoxide, sulfolane, N-formyl-morpholine, N-methyl pyrrolidone, polyethylene glycol and propylene carbonate; tetraethylene glycol and/or sulfolane are preferred.

In another implementation, the desulfurization of the medium gasoline fraction is adsorption desulfurization, and the adsorption desulfurization is carried out by using a desulfurization adsorbent, the desulfurization adsorbent is obtained by using a zeolite and an active carbon that have been respectively subjected to alkali treatment as a composite carrier to load an active metal component, where the active metal is selected from one or more elements of groups IA, VIII, IB, IIB and VIB of the period table.

In the composite carrier of the desulfurization adsorbent according to the present invention, a weight ratio of the zeolite to the active carbon is (20-80):(80-20), preferably (20-60):(80-40); the zeolite in the composite carrier of the desulfurization adsorbent is an X type, a Y type or a ZSM-5 type zeolite. The present invention does not have strict limit on employing X type or ZSM-5 type zeolite; a ratio of silicon atoms to aluminum atoms in a framework of the Y type zeolite is no less than 3.0 (as measured by an XRD method). In addition, the present invention does not have strict limit on the active carbon used, and a specific surface area thereof generally may be about 1000 $m^2/g$.

In the present invention, the active metal selected from group IA of the period table is, for instance, potassium (K), sodium (Na), etc.; the active metal selected from group VIII of the period table is, for instance, iron (Fe), cobalt (Co), nickel (Ni), etc.; the active metal selected from group IB of the period table is, for instance, copper (Cu), silver (Ag), etc.; the active metal selected from group IIB of the period table is, for instance, zinc (Zn), etc.; the active metal selected from group VIB of the period table is, for instance, molybdenum (Mo), etc.

Furthermore, the active metal in the desulfurization adsorbent is selected from at least two of Ni, Fe, Ag, Co, Mo, Zn and K. Ni may have a loading capacity of 10-30% on the composite carrier; Fe may have a loading capacity of 5-15% on the composite carrier; Ag may have a loading capacity of 5-10% on the composite carrier; Co may have a loading capacity of 5-10% on the composite carrier; Mo may have a loading capacity of 5-10% on the composite carrier; Zn may have a loading capacity of 5-15% on the composite carrier; K may have a loading capacity of 5-15% on the composite carrier. The loading capacity is a loading capacity of each active metal on the composite carrier respectively.

Furthermore, the active metal in the desulfurization adsorbent has a loading capacity of 2-30% on the composite carrier, preferably 5-25%, further preferably 5-20%. When more than two active metals are loaded on the composite carrier, the loading capacity is an overall loading capacity of the active metals.

In an implementation, the active metal is K and Ni; furthermore, K has a loading capacity of 5-15% on the composite carrier, Ni has a loading capacity of 10-25% on the composite carrier; furthermore, K and Ni which are loaded on the composite carrier have a weight ratio of (0.2-0.5):1.

In another implementation, the active metal is Zn and Fe; furthermore, Zn has a loading capacity of 5-15% on the composite carrier, Fe has a loading capacity of 8-15% on the composite carrier; furthermore, Zn and Fe which are loaded on the composite carrier have a weight ratio of (0.5-1):1.

A method for preparing the desulfurization adsorbent described above may include steps of:

preparing a composite carrier with a zeolite and an active carbon that have been respectively subjected to alkali treatment in proportion; immersing the composite carrier with a soluble salt solution of an active metal, subjecting the impregnated material to calcination after being dried so as to obtain the desulfurization adsorbent.

In an implementation, the alkali treatment includes blending the zeolite with alkali and water at a weight ratio of (0.1-2):(0.05-2):(4-15), and blending the active carbon with alkali and water at a weight ratio of (0.1-2):(0.05-2):(4-15), respectively, and stirring the blending for 0.1-24 h in a condition where a temperature is maintained between 0-120, then drying, and the alkali treatment process is proceeded at least once.

The present invention does not have strict limit on the alkali used in the alkali treatment, for instance, a solution of NaOH at 0.1-1.0 mol/L may be used. Furthermore, a temperature of the stirring treatment may be 30-100° C., and the time may be 1-10 h; furthermore, a temperature of the stirring treatment may be 70-80° C., and the time may be 2-4 h. A temperature of the drying after the stirring treatment may be, for instance, 100-120° C., and the time for drying may be, for instance, 5-8 h. The alkali treatment process may be proceeded once or twice.

In the present invention, a soluble salt solution of the active metal may be, for instance, a sulfate solution, a nitrate solution, etc., preferably the sulfate solution. The immersion may be incipient wetness impregnation, which is a conventional immersion way in the art, a specific operation thereof may be, for instance: at a room temperature and stirring, dropping the soluble salt solution of the active metal into the composite carrier until the composite carrier is aggregated into a ball, and then standing the solution for a period of time (for instance, 1-3 h). Especially, when two active metal components are loaded on the composite carrier, the composite carrier was firstly impregnated with a soluble salt solution of a first active metal, after being washed, dried and calcinated, then impregnated with a soluble salt solution of a second active metal, after being washed, dried and calcinated, a composite carrier loading two active metals components may be prepared then.

During the impregnation, the amount of soluble salt of each active metals needed for the immersion may be calculated according to a requirement for the loading capacity of each active metals on the composite carrier and a requirement for the overall loading capacity (loading more than two active metals components) of the active metals on the composite carrier.

Furthermore, the drying for the impregnated material is conducted for 12-24 h at a temperature of between 90-120° C., preferably for 18-24 h at a temperature of between 110-120° C. The impregnated material is subject to calcination for 4-6 h at a temperature of between 450-640° C. after being dried.

Furthermore, subjecting the impregnated material to calcination after being dried includes cooling the dried material down to room temperature, elevating the temperature to 400° C. at a speed of 6° C./min firstly, and then elevating the temperature to 450-640° C. at a speed of 3° C./min.

In the present invention, the adsorption desulfurization is conducted at a normal atmospheric pressure using a fixed bed, and a temperature of the adsorption desulfurization is controlled between 20-100° C., for instance, 30-80° C., a flow rate of the medium gasoline fraction is 0.3-1 mL/min, for instance, 0.5 mL/min.

The method for upgrading fluid catalytic cracking gasoline according to the present invention may further include:

washing the desulfurization adsorbent which has been subjected to the adsorption desulfurization with steam to collect a sulfur-rich component;

blending the sulfur-rich component with the heavy gasoline fraction to conduct the selective hydrodesulfurization.

Furthermore, the method for upgrading fluid catalytic cracking gasoline also includes:

after washing the desulfurization adsorbent which has been subjected to the adsorption desulfurization with the steam, drying the desulfurization adsorbent with nitrogen at a temperature of 200-400° C., and cooling the dried desulfurization adsorbent with nitrogen so as to realize regeneration of the desulfurization adsorbent.

That is, the method for regeneration of the desulfurization adsorbent includes: washing the desulfurization adsorbent to be regenerated with steam, drying the same with nitrogen at a temperature of 200-400° C. and cooling the same with nitrogen in sequence.

Specifically, steam at a temperature of 130-180° C. may be used to sweep the desulfurization adsorbent which has been subjected to the adsorption desulfurization for 1-3 h for washing, then nitrogen at a temperature of 200-400° C. is used to sweep a same for 10-60 min for drying, and finally nitrogen at a room temperature is used to sweep the same for 10-60 min for cooling.

Furthermore, according to the method for upgrading fluid catalytic cracking gasoline in the present invention, before cutting the fluid catalytic cracking gasoline into the light, the medium and the heavy gasoline fractions, the fluid catalytic cracking gasoline may be subjected to sweetening treatment firstly; or, before the light gasoline fraction is blended with the desulfurized medium gasoline fraction and the heavy gasoline fraction, the light gasoline fraction is subjected to sweetening treatment firstly to obtain a sweetened light gasoline fraction, and then the sweetened light gasoline fraction is blended with the desulfurized medium gasoline fraction and the heavy gasoline fraction to obtain upgraded gasoline.

In the present invention, a conventional method may be used for the sweetening treatment, such as an alkali extraction method or a mercaptan conversion method. The alkali extraction method uses an alkali liquor to extract mercaptan therein for its removal, the amount of alkali contained in the alkali liquor may be 5-50%, a volume ratio of oil to alkali may be (1-15):1, an operating temperature may be 10-60° C.; the mercaptan conversion method is to convert a small molecule of mercaptan into other sulfides for its removal, which may be conducted by means of a conventional alkali-free sweetening process and prehydrogenation in Prime-G+ process, where a condition for the alkali-free sweetening process may be: an operating pressure of a reactor is 0.2-1.0 MPa, a reaction temperature is 20-60° C., a feeding space velocity is 0.5-2.0 $h^{-1}$, a volume ratio of an air flow amount to a feeding quantity is 0.2-1.0, the catalyst and the cocatalyst used may be a common catalyst in the art.

Furthermore, according to the method for upgrading fluid catalytic cracking gasoline in the present invention, before the light gasoline fraction is blended with the desulfurized medium gasoline fraction and the heavy gasoline fraction, the heavy gasoline fraction may be subjected to selective hydrodesulfurization firstly to obtain a desulfurized heavy gasoline fraction, and then the desulfurized heavy gasoline fraction is blended with the light gasoline fraction and the desulfurized medium gasoline fraction to obtain upgraded gasoline.

Specifically, the heavy gasoline fraction and hydrogen may be subjected to selective hydrodesulfurization in the presence of a selective hydrodesulfurization catalyst to obtain the desulfurized heavy gasoline fraction, where a temperature of the selective hydrodesulfurization is 200-300° C., a pressure thereof is 1.5-2.5 MPa, a liquid hourly space velocity is 1-5 $h^{-1}$, a volume ratio of hydrogen to oil is 400-600.

The selective hydrodesulfurization catalyst described in the present invention may be a conventional catalyst for the selective hydrodesulfurization of gasoline in the prior art, such as catalysts RSDS-I, RSDS-21, RSDS-22 in an RSDS process, catalysts HR806 and HR841 in a Prime-G+ process, a combined catalyst of FGH-20/FGH-11 in an OCT-M process, an HDOS series deep hydrodesulfurization catalyst in a CDOS process, etc.

In an implementation, the hydrodesulfurization catalyst is obtained by a carrier which loads a third active metal component, where the carrier is a zeolite (such as the X type, the Y type or the ZSM-5 type) or a metallic oxide (such as aluminium oxide), and the third active metal includes Co and Mo. Furthermore, Co and Mo have an overall loading capacity of 5-20% on the carrier. Furthermore, Co and Mo which are loaded on the carrier have a weight ratio of (0.2-0.6):1.

Implementations of the present invention have at least the following advantages:

1. In the method for upgrading fluid catalytic cracking gasoline in the present invention, gasoline feedstock is cut into light, medium and heavy gasoline fractions, which are processed separately according to features thereof. The method is not only flexible in operation, but also helps to reduce the amount of components that need to be processed in the hydrodesulfurization; moreover, this method can realize deep desulfurization of the gasoline feedstock, and meanwhile octane number of full-range gasoline is increased by 1-3 units, thereby having a great practical value.

2. The method for upgrading fluid catalytic cracking gasoline in the present invention may use specific desulfurization adsorbents, which not only have a large sulfur capacity, good selectivity for sulfur, but also can achieve highly efficient deep desulfurization, and sulfur may be desulfurized to 1 ppmw (part per million by weight);

besides, the desulfurization adsorbents also have long lifespan and are environment-friendly.

3. According to the method for upgrading fluid catalytic cracking gasoline in the present invention, the desulfurization adsorbent may be washed subsequent to adsorption desulfurization, a sulfur-rich component formed by the washing may be blended with heavy gasoline fraction for selective hydrodesulfurization, thereby avoiding a waste of feedstocks and improving utilization of the feedstocks; meanwhile, regeneration of the desulfurization adsorbent may be realized by conducting a drying and cooling process subsequent to the washing, these processes are simple and easy to operate, and the regenerated desulfurization adsorbent does not need to be reduced by hydrogen prior to use, which is environment-friendly and economical; moreover, the desulfurization adsorbent may be regenerated many times, a relatively high sulfur capacity and an outstanding desulfurization effect can still be maintained after the regeneration.

4. According to the method for upgrading fluid catalytic cracking gasoline in the present invention, the aromatization/hydroisomerization reaction of the first desulfurized medium gasoline fraction may be carried out in a fixed bed, since gas residence time in the fixed bed reactor may be strictly controlled, and temperature distribution may be regulated, thus it helps to improve conversion and selectivity of chemical reactions; moreover, catalysts in the fixed bed reactor has good abrasion-resistance, and may be continuously used for a long time; the fixed bed reactor has a simple structure and stable operation, which is easy to control and to achieve large-scaled and continuous production.

DETAILED DESCRIPTION

In order to make objectives, technical solutions, and advantages of the present invention clearer, technical solutions in examples of the present invention will be described hereinafter clearly and completely with reference to accompanying drawings in examples of the present invention. Obviously, the described examples are only a part of examples of the present invention, rather than all examples of the present invention. All other examples obtained by persons of ordinary skill in the art based on examples of the present invention without any creative effort shall fall into the protection scope of the present invention.

Example 1

1. Prepare a Catalyst

An HZSM-5 zeolite is blended evenly with aluminum oxide at a weight ratio of 70:30 to prepare a composite carrier, where a weight ratio of the zeolite to aluminum oxide is 1:0.4.

The composite carrier prepared above is subjected to incipient wetness impregnation with an aqueous solution of $Ga_2(SO_4)_3.16H_2O$ to obtain an impregnated material; after washing the impregnated material with deionized water, drying it for 20 hours at a temperature of 120° C.; after a dried material is cooled to room temperature, the temperature is elevated to 400° C. at a speed of 6° C./min firstly, and then elevated to 550° C. at a speed of 3° C./min, at this temperature the dried material is calcinated for 4 hours, thereby preparing a catalyst, and Ga has a loading capacity of about 1.8% on the composite carrier.

2. Gasoline Upgrading

Figure 1:
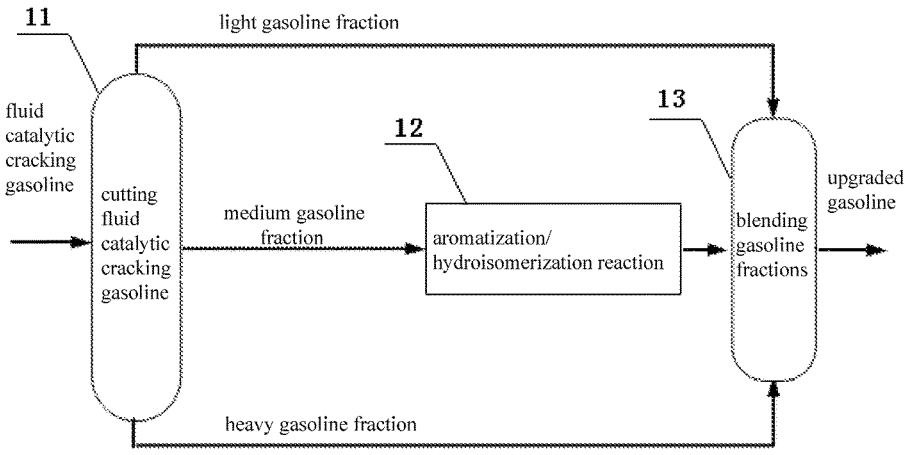
FIG. 1 is a process flow chart of a method for upgrading fluid catalytic cracking gasoline according to Example 1 of the present invention.

Fluid catalytic cracking gasoline produced from Daqing atmospheric residue by catalytic cracking is taken as a feedstock (reference may be made to Table 1 for its composition and property), and reference may be made to FIG. 1 for a process flow of a method for increasing octane number of the fluid catalytic cracking gasoline, which specifically includes:

Step 11, cutting the fluid catalytic cracking gasoline into light, medium and heavy gasoline fractions according to a boiling range from low to high, where a boiling range of the medium gasoline fraction is controlled between 40-160° C.

Step 12, after the above prepared catalyst is placed into a fixed bed reactor, introducing the medium gasoline fraction into the fixed bed reactor, and carrying out an aromatization/hydroisomerization reaction for 200 hours in the fixed bed reactor successively in a condition where a reaction temperature is 380° C., a reaction pressure is 1.5 MPa, a weight hourly space velocity is 5.0 $h^{-1}$, and a volume ratio of hydrogen to oil is 500:1.

Step 13, drawing out the resultant of the above step, and then blending the same with the light gasoline fraction and the heavy gasoline fraction, thereby obtaining upgraded gasoline, and reference may be made to Table 1 for its composition and property. It can be seen from results of Table 1 that, octane number of the upgraded gasoline is increased significantly.

Example 2

1. Prepare a Catalyst

An MCM-41 zeolite is blended with aluminum oxide at a weight ratio of 80:20 to prepare a composite carrier, where a weight ratio of the zeolite to aluminum oxide is 1:0.25.

The composite carrier prepared above is subjected to incipient wetness impregnation with a $ZnSO_4$ solution to obtain an impregnated material; after washing the impregnated material with deionized water, drying it for 24 hours at a temperature of 110° C.; after the dried material is cooled to room temperature, the temperature is elevated to 400° C. at a speed of 6° C./min firstly, and then elevated to 450° C. at a speed of 3° C./min, at this temperature the dried material is calcinated for 6 hours, thereby preparing a catalyst, and Zn has a loading capacity of about 0.5% on the composite carrier.

2. Gasoline Upgrading

Fluid catalytic cracking gasoline in Example 1 is taken as a feedstock, and a method for increasing octane number of the fluid catalytic cracking gasoline is:

Cutting the fluid catalytic cracking gasoline into light, medium and heavy gasoline fractions according to a boiling range from low to high, where a boiling range of the medium gasoline fraction is controlled between 40-160° C.

Introducing the medium gasoline fraction into a fixed bed reactor filled with the above prepared catalyst, and carrying out an aromatization/hydroisomerization reaction for 200 hours in the fixed bed reactor successively in a condition where a reaction temperature is 260, a reaction pressure is 0.8 MPa, a weight hourly space velocity is 1 $h^{-1}$, and a volume ratio of hydrogen to oil is 200:1.

Drawing out the resultant of the above step, and then blending the same with the light gasoline fraction and the heavy gasoline fraction, thereby obtaining upgraded gasoline, and reference may be made to Table 1 for its composition and property. It can be seen from results of Table 1 that, octane number of the upgraded gasoline is increased significantly.

TABLE 1

Composition and Property of Gasoline

| Item | | Gasoline feedstock | Upgraded gasoline in Example 1 | Upgraded gasoline in Example 2 |
|---|---|---|---|---|
| Density (20° C.), g/cm$^3$ | | 0.7012 | 0.7102 | 0.7123 |
| Group composition, m % | Paraffin | 35.0 | 45.3 | 40.5 |
| | Olefins | 48.2 | 23.3 | 24.5 |
| | Naphthene | 6.3 | 9.9 | 8.2 |
| | Aromatics | 10.5 | 21.5 | 26.8 |
| Octane number | RON | 90.2 | 93.5 | 94.2 |
| | MON | 80.9 | 84.1 | 84.5 |

Example 3

Figure 2:
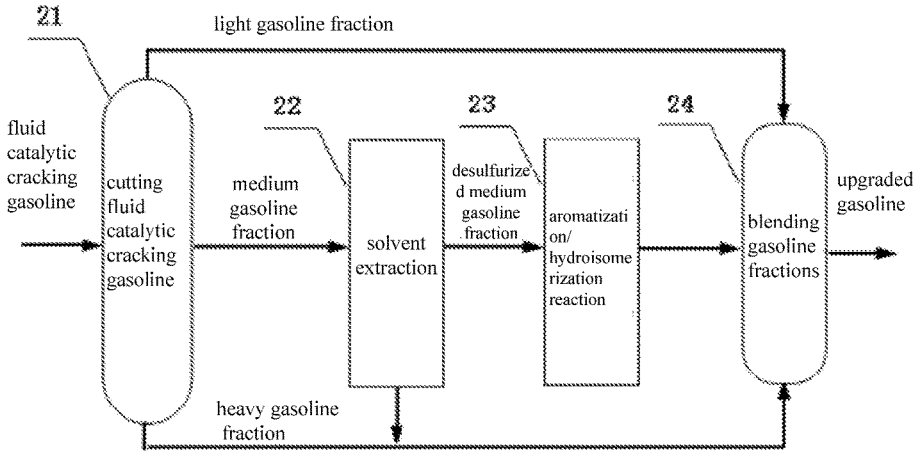
FIG. 2 is a process flow chart of a method for upgrading fluid catalytic cracking gasoline according to Example 3 of the present invention.

Fluid catalytic cracking gasoline from Jinan is taken as a feedstock (reference may be made to Table 2 for its composition and property), and reference may be made to FIG. 2 for a process flow of a method for increasing octane number of the fluid catalytic cracking gasoline, which specifically includes:

Step 21, cutting the fluid catalytic cracking gasoline into light, medium and heavy gasoline fractions according to a boiling range from low to high, where a boiling range of the medium gasoline fraction is controlled between 40-150° C.

Step 22, introducing the medium gasoline fraction from a middle lower part of an extraction tower and tetraethylene-glycol from a top of the extraction tower, and meanwhile injecting n-pentane to a backflow device at the bottom of the extraction tower, controlling a temperature at the top of the extraction tower at 80° C., a temperature at the bottom of the extraction tower at 60° C., and a pressure (absolute pressure) at the top of the extraction tower at 0.5 MPa, controlling a weight ratio of tetraethylene-glycol to the medium gasoline fraction at 3.0, and controlling a weight ratio of n-pentane to the medium gasoline fraction at 0.3.

During the extraction, the medium gasoline fraction is in contact with tetraethylene-glycol at an upper section of the extraction tower via a multi-stage countercurrent, while n-pentane is in full contact with tetraethylene-glycol at a lower section of the extraction tower, where desulfurized medium gasoline fraction is carried by tetraethylene-glycol and distilled out of the top of the tower, and after washing the desulfurized medium gasoline fraction with water to remove tetraethylene-glycol, the desulfurized medium gasoline fraction is obtained;

The medium gasoline fraction that continues going downwards along with tetraethylene-glycol is in full contact with N-pentane at the lower section of the extraction tower, and is discharged out of the tower at the bottom along with n-pentane; n-pentane therein is returned to the backflow device of the extraction tower, and water therein is returned to the step of washing the desulfurized medium gasoline fraction with water to remove the solvent as washing water, and tetraethylene-glycol therein is returned to the top of the extraction tower, residual sulfur-rich oil content is collected.

Step 23, introducing the desulfurized medium gasoline fraction into a fixed bed reactor filled with the catalyst prepared in Example 1, and carrying out an aromatization/hydroisomerization reaction for 200 hours in the fixed bed reactor successively in a condition where a reaction temperature is 300° C., a reaction pressure is 1 MPa, a weight hourly space velocity is 2.5 $h^{-1}$, and a volume ratio of hydrogen to oil is 350:1.

Step 24, drawing out the resultant of the above step, and then blending the same with the light gasoline fraction, the residual sulfur-rich oil content and the heavy gasoline fraction, thereby obtaining upgraded gasoline, and reference may be made to Table 2 for its composition and property. It can be seen from results of Table 2 that, octane number of the upgraded gasoline is increased significantly.

Example 4

1. Prepare a Catalyst

A ZSM-5 zeolite is blended with aluminum oxide at a weight ratio of 83:17 to prepare a composite carrier, where a weight ratio of the zeolite to aluminum oxide is 1:0.2.

The composite carrier prepared above is subjected to incipient wetness impregnation with an aqueous solution of $Ga_2(SO_4)_3.16H_2O$ to obtain an impregnated material; after washing the impregnated material with deionized water, drying it for 18 hours at a temperature of 120° C.; after the dried material is cooled to room temperature, the temperature is elevated to 400° C. at a speed of 6° C./min firstly, and then elevated to 640° C. at a speed of 3° C./min, at this temperature the dried material is calcinated for 5 hours, thereby preparing a catalyst, and Ga has a loading capacity of about 3% on the composite carrier.

2. Gasoline Upgrading

Fluid catalytic cracking gasoline in Example 3 is taken as a feedstock, and a method for increasing octane number of the fluid catalytic cracking gasoline includes:

Cutting the fluid catalytic cracking gasoline into light, medium and heavy gasoline fractions according to a boiling range from low to high, where a boiling range of the medium gasoline fraction is controlled between 50-130° C.

Introducing the medium gasoline fraction from a middle lower part of an extraction tower and sulfolane from a top of the extraction tower, and meanwhile injecting isopentane to a backflow device at the bottom of the extraction tower, controlling a temperature at the top of the extraction tower at 60° C., a temperature at the bottom of the extraction tower at 40° C., and a pressure (absolute pressure) at the top of the extraction tower at 0.2 MPa, controlling a weight ratio of sulfolane to the medium gasoline fraction at 1.0, and controlling a weight ratio of isopentane to the medium gasoline fraction at 0.1, collecting desulfurized medium gasoline fraction and residual sulfur-rich oil content.

Introducing the desulfurized medium gasoline fraction into a fixed bed reactor filled with the catalyst prepared above, and carrying out an aromatization/hydroisomerization reaction for 200 hours in the fixed bed reactor successively in a condition where a reaction temperature is 400° C., a reaction pressure is 2 MPa, a weight hourly space velocity is 6 $h^{-1}$, and a volume ratio of hydrogen to oil is 800:1.

Drawing out the resultant of the above step, and then blending the same with the light gasoline fraction, the residual sulfur-rich oil content and the heavy gasoline fraction, thereby obtaining upgraded gasoline, and reference may be made to Table 2 for its composition and property. It can be seen from results of Table 2 that, octane number of the upgraded gasoline is increased significantly.

TABLE 2

Composition and Property of Gasoline

| Item | | Gasoline feedstock | Upgraded gasoline in Example 3 | Upgraded gasoline in Example 4 |
|---|---|---|---|---|
| Density (20° C.), g/cm³ | | 0.7562 | 0.7780 | 0.7685 |
| Group composition, m % | Paraffin | 25.6 | 33.6 | 28.8 |
| | Olefins | 30.9 | 13.8 | 21.6 |
| | Naphthene | 8.9 | 14.2 | 13.6 |
| | Aromatics | 34.6 | 38.4 | 36.0 |
| Octane number | RON | 89.2 | 93.7 | 92.0 |
| | MON | 80.1 | 84.5 | 81.6 |

Example 5

1. Prepare a Desulfurization Adsorbent

1) Prepare a Zeolite and an Active Carbon Subjected to Alkali Treatment

After elevating temperatures of two parts 500 mL of NaOH solutions at a concentration of 0.3 mol/L to about 70° C. by a water bath, adding 25 g of ZSM-5 type zeolite and 25 g of active carbon therein respectively to obtain a blending, after stirring the blending for about 200 minutes, immediately lowering a temperature of the blending to a normal atmospheric temperature by an ice bath, filtering the blending and collecting a filter cake, washing the filter cake with deionized water several times till a pH value of the filtrate is about 7, placing the filter cake obtained into an oven at a temperature of 110° C. to be dried for 4 h, and thus a ZSM-5 type zeolite subjected to alkali treatment and an active carbon subjected to alkali treatment are prepared respectively;

In addition, an ASAP2000 type automatically physical adsorption instrument is used to measure specific surface areas and pore diameter distributions of the ZSM-5 type zeolite and the active carbon, and results are as shown in Table 3.

Table 3 Specific Surface Areas and Pore Diameters of ZSM-5 Type Zeolite and Active Carbon

| Carrier | Total specific surface area $S_{BET}$/ ($m^2 \cdot g^{-1}$) | Total pore volume V/ ($cm^3 \cdot g^{-1}$) | Medium pore volume $V_{meso}$/ ($cm^3 \cdot g^{-1}$) | Average pore diameter d/ (nm) |
|---|---|---|---|---|
| ZSM-5 zeolite before alkali treatment | 380 | 0.212 | 0.041 | 2.241 |
| ZSM-5 zeolite after alkali treatment | 427 | 0.430 | 0.300 | 4.031 |
| Active carbon before alkali treatment | 1190 | 0.701 | 0.326 | 2.321 |
| Active carbon after alkali treatment | 1254 | 0.742 | 0.358 | 2.427 |

Figure 3:
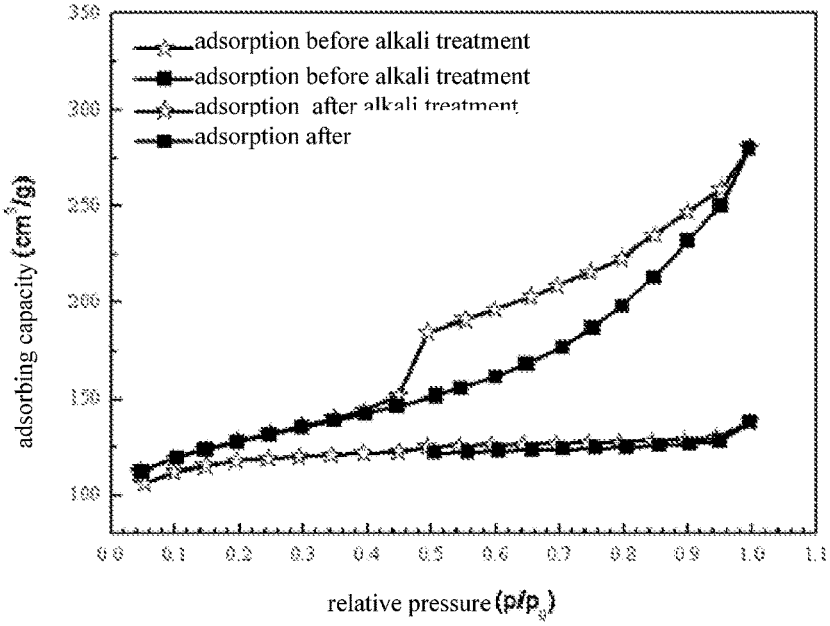
FIG. 3 is absorption-desorption isotherms of a ZSM-5 type zeolite before and after alkali treatment according to Example 5.

It can be seen from FIG. 3 that: the ZSM-5 zeolite before alkali treatment exhibits an I-type isotherm which is particular to micropore properties, the desorption isotherm thereof is almost overlapped with the adsorption isotherm; whereas the ZSM-5 zeolite after alkali treatment exhibits an IV-type isotherm with obvious characteristics, which presents a continuous adsorption state till a saturation pressure within the entire measured pressure range, and which conducts desorption slowly with decrease in the pressure during the desorption firstly, when the pressure reaches a certain value, the desorption amount surges suddenly to form a relatively steep curve, and then the desorption isotherm is overlapped with the adsorption isotherm with a continuous decrease in the pressure, thus it indicates that a great number of mesopores (medium pores) are generated in the ZSM-5 zeolite after alkali treatment.

Figure 4:
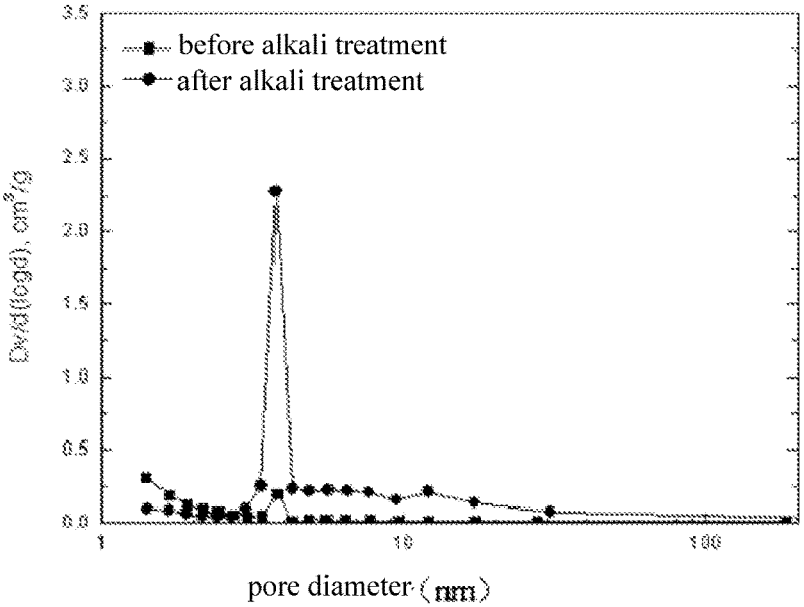
FIG. 4 is a curve of pore diameter distribution of a ZSM-5 type zeolite before and after alkali treatment according to Example 5.

It can be seen from FIG. 4 that, the ZSM-5 zeolite before alkali treatment is mainly contains micropores, there is a wide distribution before 2 nm, there is a small peak at a position of 3.5 nm, and there are basically no pores after 4 nm, an average pore diameter calculated through a t-plot method is about 2.3 nm; there is still a distribution of a part of micropores before 2 nm for the ZSM-5 zeolite after alkali treatment, and there is a strong peak at a position of about 3.8 nm, the peak is almost about 11 times the height of the ZSM-5 zeolite before alkali treatment, and there is also a relative wide distribution of pores after 4 nm.

Meanwhile, a result of Table 3 shows that: a medium pore volume and an average pore diameter of the ZSM-5 type zeolite after being subjected to alkali treatment are increased significantly, which indicates that a large number of micropores are converted into medium pores, thereby forming a structure of a composite pore of a mesopore and a micropore; the total specific surface area, the total pore volume, the medium pore volume and the average pore diameter of the active carbon after being subjected to alkali treatment are all increased.

2) Prepare a First Composite Carrier

The ZSM-5 type zeolite subjected to alkali treatment and the active carbon subjected to alkali treatment are placed in a mortar and grounded into powders after being blended at a weight ratio of 40:60, then the powders are placed in an oven at a temperature of 120° C. to be dried for 6 h, thereby a first composite carrier is prepared.

3) Prepare a Desulfurization Adsorbent

The first composite carrier prepared above is subjected to incipient wetness impregnation with a $K_2SO_4$ solution firstly to obtain a first impregnated material, after washing, drying and calcinating the first impregnated material, the first impregnated material is subjected to incipient wetness impregnation with $NiSO_4$ to obtain a second impregnated material, after drying and calcinating the second impregnated material, a desulfurization adsorbent is prepared;

The washing, the drying and the calcinating described above are specifically: after washing the impregnated material with deionized water, drying it for 20 hours at a temperature of 120° C., after the dried material is cooled to room temperature, elevating the temperature to 400° C. at a speed of 6° C./min firstly, and then elevating the temperature to 550° C. at a speed of 3° C./min, at this temperature the dried material is calcinated for 4 hours.

In the desulfurization adsorbent prepared above, K has a loading capacity of about 5% on the first composite carrier, Ni has a loading capacity of about 10% on the first composite carrier; moreover, K and Ni which are loaded on the first composite carrier have a weight ratio of 0.5:1. Upon detection, a sulfur capacity of the desulfurization adsorbent is 0.514, and its lifespan lasts for 8-9 h.

In the present invention, the sulfur capacity refers to total sulfur content (by gram) removed when 1 g of desulfurization adsorbent reduces the total sulfur content in the gasoline feedstock below 10 ppmw, for instance, when the sulfur capacity is 0.514, it indicates that the total sulfur content removed when 1 g of desulfurization adsorbent reduces the total sulfur content in the gasoline feedstock below 10 ppmw is 0.514 g.

2. Prepare a Selective Hydrodesulfurization Catalyst

A ZSM-5 type zeolite is subjected to incipient wetness impregnation with a $CoSO_4$ solution firstly to obtain a first impregnated material, after washing, drying and calcinating the first impregnated material, the first impregnated material is subjected to incipient wetness impregnation with an aqueous solution of $(NH_4)_6Mo_7O_{24}.4H_2O$ to obtain a second impregnated material, after washing, drying and calcinating the second impregnated material, a selective hydrodesulfurization catalyst is prepared, where, reference may be made to step 1 for a specific operation of the washing, the drying and the calcinating.

A total specific surface area of the selective hydrodesulfurization catalyst prepared above is about 356 $m^2/g$, a total pore volume is about 0.315 $cm^3 \cdot g^{-1}$, Co has a loading capacity of about 4% on the carrier, Mo has a loading capacity of about 10% on the carrier; moreover, Co and Mo which are loaded on the carrier have a weight ratio of 0.4:1.

3. Prepare a Catalyst for an Aromatization/Hydroisomerization Reaction

An HZSM-5 zeolite is blended with aluminum oxide at a weight ratio of 70:30 to prepare a second composite carrier, where a weight ratio of the zeolite to aluminum oxide is 1:0.4.

The second composite carrier prepared above is subjected to incipient wetness impregnation with an aqueous solution of $Ga_t(SO_4)_3.16H_2O$ to obtain a impregnated material; upon washing, drying and calcinating the impregnated material, a catalyst for an aromatization/hydroisomerization reaction is prepared; reference may be made to step 1 for a specific operation of the washing, the drying and the calcinating, and Ga has a loading capacity of about 1.8% on the second composite carrier.

4. Gasoline Upgrading

Figure 5:
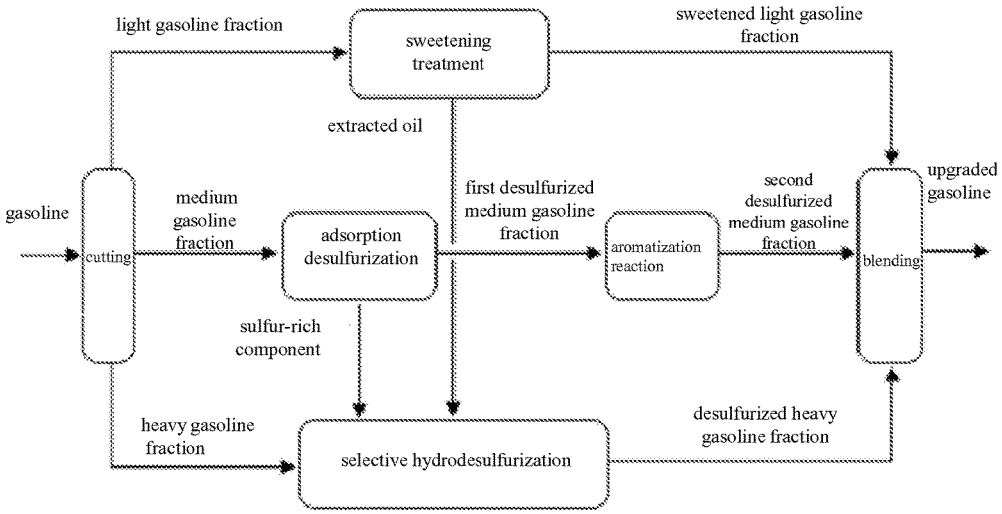
FIG. 5 is a process flow chart of a method for upgrading fluid catalytic cracking gasoline according to Example 5 of the present invention.

Fluid catalytic cracking gasoline produced from Daqing atmospheric residue by catalytic cracking is taken as a feedstock (reference may be made to Table 4 for its composition), and reference may be made to FIG. 5 for a process flow of manufacturing of upgraded gasoline based on such gasoline feedstock.

Firstly, cutting the gasoline feedstock into light, medium and heavy gasoline fractions, where a cutting temperature of the light and the medium gasoline fractions is 60° C., and a cutting temperature of the medium and the heavy gasoline fractions is 100° C.

Contacting the light gasoline fraction with an alkali solution for sweetening treatment in an extraction system, where the alkali used is a 20 wt % NaOH solution, a volume ratio of the light gasoline fraction to the NaOH solution is 5:1, an operating temperature is 30° C., sweetened light gasoline fraction and extracted oil are collected, and the extracted oil is incorporated into the heavy gasoline fraction to proceed with a next step.

Filling the desulfurization adsorbent prepared above into a fixed bed reactor, at a temperature of 30° C. and normal atmospheric pressure, subjecting the medium gasoline fraction to adsorption desulfurization at a flow rate of 0.5 mL/min to obtain a first desulfurized medium gasoline fraction; moreover, after the adsorption desulfurization, sweeping the desulfurization adsorbent that has been subjected to the adsorption desulfurization with steam at a temperature of 150° C. for 3 h for washing, collecting a sulfur-rich component, incorporating the sulfur-rich component into the heavy gasoline fraction to proceed with a next step. Moreover, sweeping the washed desulfurization adsorbent with nitrogen at a temperature of 300° C. for 30 min for drying, and sweeping the dried desulfurization adsorbent with nitrogen at a room temperature (30° C.) for 30 min for cooling, so that the desulfurization adsorbent is regenerated, a sulfur capacity of the desulfurization adsorbent after being regenerated three times is 0.473, and its lifespan lasts for about 7 h.

After the above catalyst prepared for the aromatization/hydroisomerization reaction is placed into a fixed bed reactor, introducing the first desulfurized medium gasoline fraction into the fixed bed reactor, and carrying out an aromatization/hydroisomerization reaction for 200 hours in the fixed bed reactor successively in a condition where a reaction temperature is 380° C., a reaction pressure is 1.5 MPa, a weight hourly space velocity is 5.0 $h^{-1}$, and a volume ratio of hydrogen to oil is 500:1, thereby obtaining a second desulfurized medium gasoline fraction.

Filling the selective hydrodesulfurization catalyst prepared above into a fixed bed reactor, subjecting the heavy gasoline fraction incorporated with the extracted oil and the sulfur-rich component to selective hydrodesulfurization in a condition where a reaction temperature is 260° C., a reaction pressure is 1.8 MPa, a liquid hourly space velocity is 3.0 $h^{-1}$, and a volume ratio of hydrogen to oil is 500:1, thereby obtaining a desulfurized heavy gasoline fraction. The desulfurized heavy gasoline fraction is blended with the sweetened light gasoline fraction and the second desulfurized medium gasoline fraction to prepare upgraded gasoline, reference may be made to Table 4 for its composition.

Example 6

1. Prepare a Selective Hydrodesulfurization Catalyst

A selective hydrodesulfurization catalyst is prepared according to the method described in Example 5, the difference lies in that, a loading capacity of Co on the carrier is controlled at about 6%, a loading capacity of Mo on the carrier is controlled at about 10%, and Co and Mo which are loaded on the carrier have a weight ratio of 0.6:1.

2. Prepare a Catalyst for an Aromatization/Hydroisomerization Reaction

An MCM-41 zeolite is blended with aluminum oxide at a weight ratio of 80:20 to prepare a second composite carrier, where a weight ratio of the zeolite to aluminum oxide is 1:0.25.

The second composite carrier prepared above is subjected to incipient wetness impregnation with a $ZnSO_4$ solution to obtain an impregnated material; after washing the impregnated material with deionized water, drying it for 24 hours at a temperature of 110° C.; after cooling down the dried material to room temperature, the temperature is elevated to 400° C. at a speed of 6° C./min firstly, and then elevated to 450° C. at a speed of 3° C./min, at this temperature the dried material is calcinated for 6 hours, thereby preparing a catalyst, and Zn has a loading capacity of about 0.5% on the second composite carrier.

3. Gasoline Upgrading

Figure 6:
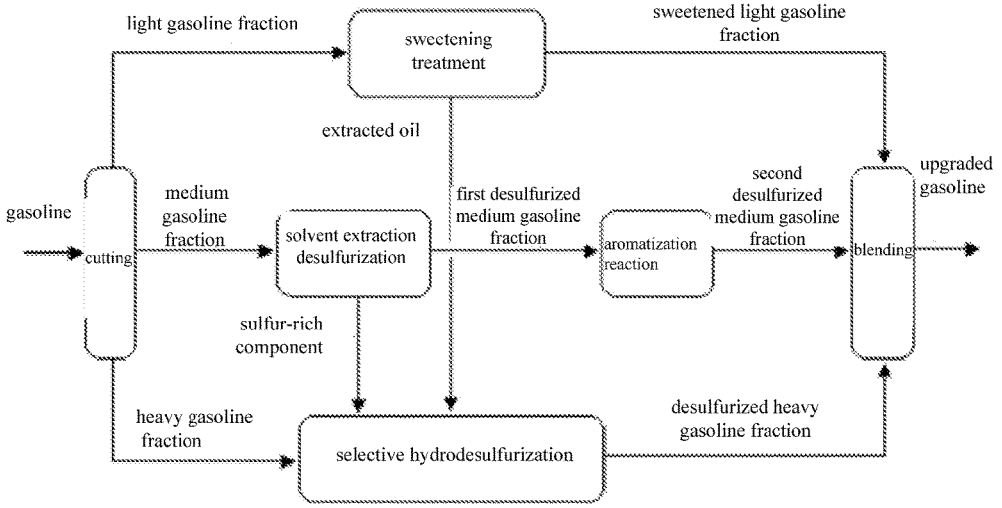
FIG. 6 is a process flow chart of a method for upgrading fluid catalytic cracking gasoline according to Example 6 of the present invention.

Fluid catalytic cracking gasoline from Daqing is taken as a feedstock (reference may be made to Table 4 for its composition), and reference may be made to FIG. 6 for a process flow of manufacturing of upgraded gasoline based on such gasoline feedstock.

Firstly, cutting the gasoline feedstock into light, medium and heavy gasoline fractions, where a cutting temperature of the light and the medium gasoline fractions is 50° C., and a cutting temperature of the medium and the heavy gasoline fractions is 90° C.

Contacting the light gasoline fraction with an alkali solution for sweetening treatment in an extraction system, where the alkali used is a 10 wt % NaOH solution, a volume ratio of the light gasoline fraction to the NaOH solution is 5:1, an operating temperature is 45° C., sweetened light gasoline fraction and extracted oil are collected, and the extracted oil is incorporated into the heavy gasoline fraction to proceed with a next step.

Introducing the medium gasoline fraction from a middle lower part of an extraction tower and tetraethylene-glycol from a top of the extraction tower, and meanwhile injecting n-pentane to a backflow device at the bottom of the extraction tower, controlling a temperature at the top of the extraction tower at 80° C., a temperature at the bottom of the extraction tower at 60° C., and a pressure (absolute pressure) at the top of the extraction tower at 0.5 MPa, controlling a weight ratio of tetraethylene-glycol to the medium gasoline fraction at 3.0, and controlling a weight ratio of n-pentane to the medium gasoline fraction at 0.3.

During the extraction, the medium gasoline fraction is in contact with tetraethylene-glycol at an upper section of the extraction tower via a multi-stage countercurrent, while n-pentane is in full contact with tetraethylene-glycol at a lower section of the extraction tower, where desulfurized medium gasoline fraction is carried by tetraethylene-glycol and distilled out of the top of the tower, and after washing the desulfurized medium gasoline fraction with water to remove tetraethylene-glycol, the first desulfurized medium gasoline fraction is obtained;

The medium gasoline fraction that continues going downwards along with tetraethylene-glycol is in full contact with n-pentane at the lower section of the extraction tower, and is discharged out of the tower at the bottom along with n-pentane; n-pentane therein is returned to the backflow device of the extraction tower, and water therein is returned to the step of washing the desulfurized medium gasoline fraction with water to remove the solvent as washing water, and tetraethylene-glycol therein is returned to the top of the extraction tower, sulfur-rich oil content is collected and is incorporated into the heavy gasoline fraction to proceed with a next step.

Introducing the first desulfurized medium gasoline fraction into a fixed bed reactor filled with the catalyst prepared for the aromatization/hydroisomerization reaction, and carrying out an aromatization/hydroisomerization reaction for 200 hours in the fixed bed reactor successively in a condition where a reaction temperature is 260° C., a reaction pressure is 0.8 MPa, a weight hourly space velocity is 1 $h^{-1}$, and a volume ratio of hydrogen to oil is 200:1, thereby obtaining the second desulfurized medium gasoline fraction.

Filling the selective hydrodesulfurization catalyst prepared above into a fixed bed reactor, subjecting the heavy gasoline fraction incorporated with the extracted oil and the sulfur-rich component to selective hydrodesulfurization in a condition where a reaction temperature is 300° C., a reaction pressure is 1.5 MPa, a liquid hourly space velocity is 4.0 $h^{-1}$, and a volume ratio of hydrogen to oil is 600:1, thereby obtaining a desulfurized heavy gasoline fraction. The desulfurized heavy gasoline fraction is blended with the sweetened light gasoline fraction and the second desulfurized medium gasoline fraction to prepare upgraded gasoline, reference may be made to Table 4 for its composition.

TABLE 4

Composition of Gasoline before and after Upgrading

| Item | | Gasoline feedstock | Upgraded gasoline in Example 5 | Upgraded gasoline in Example 6 |
|---|---|---|---|---|
| Density (20° C.), g/cm$^3$ | | 0.7012 | 0.7252 | 0.7236 |
| Sulfur content, ppmw | | 282 | 8.0 | 8.0 |
| Group | Paraffin | 35.0 | 43.2 | 43.3 |
| composition, | Olefins | 48.2 | 20.8 | 17.6 |
| m % | Naphthene | 6.3 | 12.7 | 12.5 |
| | Aromatics | 10.5 | 23.3 | 26.6 |
| Octane | RON | 90.2 | 91.8 | 92.5 |
| number | MON | 80.9 | 82.5 | 83.0 |

It can be seen from Table 4 that:

The method for upgrading gasoline as described in Example 5 and Example 6 of the present invention not only can reduce sulfur content in the gasoline feedstock below 10 ppm, but also can control olefins content below 24%, and octane number is increased significantly.

Example 7

1. Prepare a Desulfurization Adsorbent

1) Prepare a Zeolite and an Active Carbon Subjected to Alkali Treatment

After elevating temperatures of two 500 mL of NaOH solutions at a concentration of 0.2 mol/L to about 80° C. by a water bath, adding 25 g of Y type zeolite and 25 g of active carbon therein respectively, immediately lowering a temperature of the blending to a normal atmospheric temperature by an ice bath after stirring for about 120 minutes, filtering the blending and collecting a filter cake, washing the filter cake with deionized water several times till a pH value of the filtrate is about 7, placing the filter cake obtained into an oven at a temperature of 120° C. to be dried for 3 h, and thus a Y type zeolite subjected to alkali treatment and an active carbon subjected to alkali treatment are prepared, respectively; specific surface areas and pore diameter distributions of the Y type zeolite and the active carbon are shown in Table 5.

TABLE 5

Specific Surface Areas and Pore Diameters of Y type zeolite and Active Carbon

| Carrier | Total specific surface area $S_{BET}$/ ($m^2 \cdot g^{-1}$) | Total pore volume V/ ($cm^3 \cdot g^{-1}$) | Medium pore volume $V_{meso}$/ ($cm^3 \cdot g^{-1}$) | Average pore diameter d/ (nm) |
|---|---|---|---|---|
| Y type zeolite before alkali treatment | 706 | 0.390 | 0.053 | 2.001 |
| Y type zeolite after alkali treatment | 713 | 0.462 | 0.118 | 2.139 |
| Active carbon before alkali treatment | 1190 | 0.701 | 0.326 | 2.321 |
| Active carbon after alkali treatment | 1233 | 0.729 | 0.355 | 2.346 |

2) Prepare a First Composite Carrier

The Y type zeolite subjected to alkali treatment and the active carbon subjected to alkali treatment are placed in a mortar and grounded into powders after being blended at a weight ratio of 20:80, then the powders are placed in an oven at a temperature of 110° C. to be dried for 6 h, thereby preparing a first composite carrier.

3) Prepare a Desulfurization Adsorbent

The first composite carrier prepared above is subjected to incipient wetness impregnation with a $ZnSO_4$ solution firstly to obtain a first impregnated material, after washing, drying and calcinating the first impregnated material, the first impregnated material is subjected to incipient wetness impregnation with a $Fe_2(SO_4)_3$ solution to obtain a second impregnated material, after drying and calcinating the second impregnated material, a desulfurization adsorbent is prepared;

The washing, the drying and the calcinating described above are specifically: after washing the impregnated material with deionized water, drying it for 24 hours at a temperature of 110° C., after the dried material is cooled to room temperature, elevating the temperature to 400° C. at a speed of 6° C./min firstly, and then elevating the temperature to 450° C. at a speed of 3° C./min, at this temperature the dried material is calcinated for 6 hours.

In the desulfurization adsorbent prepared above, Zn has a loading capacity of about 10% on the first composite carrier, Fe has a loading capacity of about 10% on the first composite carrier; moreover, Zn and Fe which are loaded on the first composite carrier have a weight ratio of 1:1. Upon detection, a sulfur capacity of the desulfurization adsorbent is 0.481, and its lifespan lasts for 7-8 h.

2. Prepare a Selective Hydrodesulfurization Catalyst

A selective hydrodesulfurization catalyst is prepared according to the method described in Example 5, the difference lies in that, a loading capacity of Co on the carrier is controlled at about 2%, a loading capacity of Mo on the carrier is controlled at about 8%, and Co and Mo which are loaded on the carrier have a weight ratio of 0.25:1.

3. Gasoline Upgrading

Figure 7:
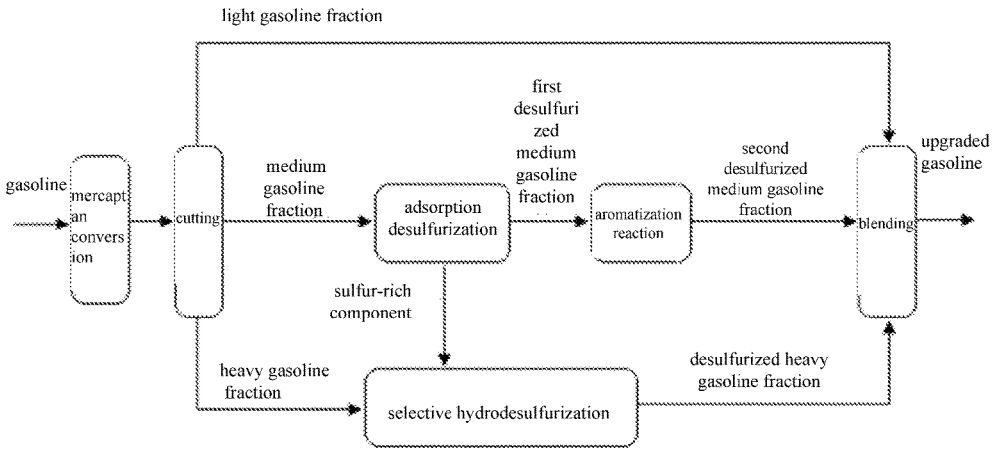
FIG. 7 is a process flow chart of a method for upgrading fluid catalytic cracking gasoline according to Example 7 of the present invention.

Fluid catalytic cracking gasoline from Jinan is taken as a feedstock (reference may be made to Table 6 for its composition), and reference may be made to FIG. 7 for a process flow of desulfurization of the gasoline feedstock.

Firstly, a mercaptan conversion method (an alkali-free sweetening process) is used to subject the gasoline feedstock to sweetening treatment, where an operating pressure of the reactor may be controlled at about 0.5 MPa, a reaction temperature is controlled at about 40° C., a feeding space velocity is 1.0 $h^{-1}$ and a volume ratio of an air flow rate to a feeding rate is about 0.5, thereby obtaining sweetened gasoline.

The sweetened gasoline is cut into light, medium and heavy gasoline fractions, where a cutting temperature of the light and the medium gasoline fractions is 60° C., and a cutting temperature of the medium and the heavy gasoline fractions is 100° C.

Filling the desulfurization adsorbent prepared above into a fixed bed reactor, at a temperature of 30° C. and normal atmospheric pressure, subjecting the medium gasoline fraction to adsorption desulfurization at a flow rate of 0.3 mL/min to obtain a first desulfurized medium gasoline fraction; moreover, after the adsorption desulfurization, sweeping the desulfurization adsorbent that has been subjected to the adsorption desulfurization with steam at a temperature of 180° C. for 1 h for washing, collecting a sulfur-rich component, incorporating the sulfur-rich component into the heavy gasoline fraction to proceed with a next step. Moreover, sweeping the washed desulfurization adsorbent with nitrogen at a temperature of 400° C. for 10 min for drying, and sweeping the dried desulfurization adsorbent with nitrogen at a room temperature (10° C.) for 10 min for cooling, so that the desulfurization adsorbent is regenerated, a sulfur capacity of the desulfurization adsorbent after being regenerated three times is 0.481, and its lifespan lasts for about 7 h.

Introducing the first desulfurized medium gasoline fraction into a fixed bed reactor filled with the catalyst for the aromatization/hydroisomerization reaction as prepared in Example 5, and carrying out an aromatization/hydroisomerization reaction for 200 hours in the fixed bed reactor successively in a condition where a reaction temperature is 300° C., a reaction pressure is 1 MPa, a weight hourly space velocity is 2.5 $h^{-1}$, and a volume ratio of hydrogen to oil is 350:1, thereby obtaining second desulfurized medium gasoline fraction.

Filling the selective hydrodesulfurization catalyst prepared above into a fixed bed reactor, subjecting the heavy gasoline fraction incorporated with the sulfur-rich component to selective hydrodesulfurization in a condition where a reaction temperature is 300° C., a reaction pressure is 1.5 MPa, a liquid hourly space velocity is 4.0 $h^{-1}$, and a volume ratio of hydrogen to oil is 600, thereby obtaining a desulfurized heavy gasoline fraction.

The desulfurized heavy gasoline fraction is blended with the light gasoline fraction and the second desulfurized medium gasoline fraction to prepare upgraded gasoline, reference may be made to Table 6 for its composition.

Example 8

1. Prepare a Catalyst for an Aromatization/Hydroisomerization Reaction

A ZSM-5 zeolite is blended with aluminum oxide at a weight ratio of 83:17 to prepare a composite carrier, where a weight ratio of the zeolite to aluminum oxide is 1:0.2.

The composite carrier prepared above is subjected to incipient wetness impregnation with an aqueous solution of $Ga_t(SO_4)_3 16.H_2O$ to obtain a impregnated material; after washing the impregnated material with deionized water, drying it for 18 hours at a temperature of 120° C.; after cooling down the dried material to room temperature, the temperature is elevated to 400° C. at a speed of 6° C./min firstly, and then elevated to 640° C. at a speed of 3° C./min, at this temperature the dried material is calcinated for 5 hours, thereby preparing a catalyst, and Ga has a loading capacity of about 3% on the composite carrier.

2. Gasoline Upgrading

Figure 8:
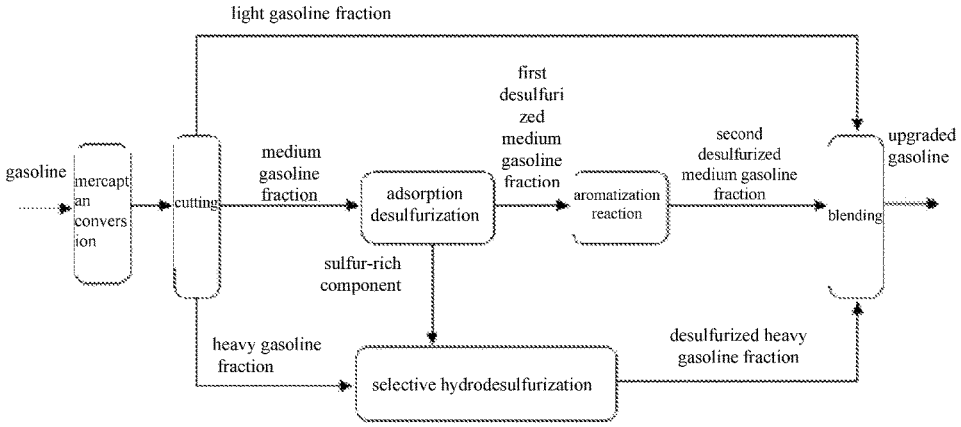
FIG. 8 is a process flow chart of a method for upgrading fluid catalytic cracking gasoline according to Example 8 of the present invention.

Fluid catalytic cracking gasoline from Jinan is taken as a feedstock (reference may be made to Table 6 for its composition), and reference may be made to FIG. 8 for a process flow of upgrading of the gasoline feedstock.

Firstly, a mercaptan conversion method (an alkali-free sweetening process) is used to subject the gasoline feedstock to sweetening treatment, where an operating pressure of the reactor may be controlled at about 0.3 MPa, a reaction temperature is controlled at about 60° C., a feeding space velocity is 1.5 $h^{-1}$ and a volume ratio of an air flow rate to a feeding rate is about 1.0, thereby obtaining sweetened gasoline.

The sweetened gasoline is cut into light, medium and heavy gasoline fractions, where a cutting temperature of the light and the medium gasoline fractions is 50° C., and a cutting temperature of the medium and the heavy gasoline fractions is 90° C.

Introducing the medium gasoline fraction from a middle lower part of an extraction tower and sulfolane from a top of the extraction tower, and meanwhile injecting isopentane to a backflow device at the bottom of the extraction tower, controlling a temperature at the top of the extraction tower at 60° C., a temperature at the bottom of the extraction tower at 40° C., and a pressure (absolute pressure) at the top of the extraction tower at 0.2 MPa, controlling a weight ratio of sulfolane to the medium gasoline fraction at 1.0, and controlling a weight ratio of isopentane to the medium gasoline fraction at 0.1, thereby collecting first desulfurized medium gasoline fraction and sulfur-rich oil content respectively.

Introducing the first desulfurized medium gasoline fraction into a fixed bed reactor filled with the catalyst for the aromatization/hydroisomerization reaction as prepared above, and carrying out an aromatization/hydroisomerization reaction for 200 hours in the fixed bed reactor successively in a condition where a reaction temperature is 400° C., a reaction pressure is 2 MPa, a weight hourly space velocity is 6 $h^{-1}$, and a volume ratio of hydrogen to oil is 800:1, thereby obtaining second desulfurized medium gasoline fraction;

Filling the selective hydrodesulfurization catalyst prepared in Example 5 into a fixed bed reactor, subjecting the heavy gasoline fraction incorporated with the extracted oil and the sulfur-rich component to selective hydrodesulfurization in a condition where a reaction temperature is 300° C., a reaction pressure is 2.5 MPa, a liquid hourly space velocity is 2.0 $h^{-1}$, and a volume ratio of hydrogen to oil is 400, thereby obtaining a desulfurized heavy gasoline fraction. The desulfurized heavy gasoline fraction is blended with the light gasoline fraction and the second desulfurized medium gasoline fraction to prepare upgraded gasoline, reference may be made to Table 6 for its composition.

TABLE 6

Composition of Gasoline before and after Upgrading

| Item | | Gasoline feedstock | Desulfurized gasoline in Example 7 | Desulfurized gasoline in Example 8 |
|---|---|---|---|---|
| Density (20° C.), g/cm$^3$ | | 0.7562 | 0.7764 | 0.7783 |
| Sulfur content, ppmw | | 421 | 10 | 10 |
| Group composition, m % | Paraffin | 25.6 | 37.3 | 33.8 |
| | Olefins | 30.9 | 15.6 | 13.6 |
| | Naphthene | 8.9 | 11.5 | 14.4 |
| | Aromatics | 34.6 | 35.6 | 38.2 |
| Octane number | RON | 89.2 | 91.7 | 92.4 |
| | MON | 80.1 | 82.2 | 82.5 |

It can be seen from Table 6 that:

The method for upgrading gasoline as described in Example 7 and Example 8 of the present invention not only can reduce sulfur content in the gasoline feedstock below 10 ppm, but also can control olefins content below 24%, and octane number is increased significantly.

Comparative Example 1

After preparing a ZSM-5 type zeolite subjected to alkali treatment according to the method as described in Example 5, the ZSM-5 type zeolite after alkali treatment is sequentially subjected to incipient wetness impregnation with a $K_2SO_4$ solution and a $NiSO_4$ solution according to the method described in Example 5, washing, drying and calcinating the impregnated material, thereby preparing a desulfurization adsorbent. Upon detection, a sulfur capacity of the desulfurization adsorbent is 0.286, and its lifespan is only 3-4 h.

Comparative Example 2

After preparing an active carbon subjected to alkali treatment according to the method as described in Example 5, the active carbon after alkali treatment is sequentially subjected to incipient wetness impregnation with a $K_2SO_4$ solution and a $NiSO_4$ solution according to the method described in Example 5, washing, drying and calcinating the impregnated material, thereby preparing a desulfurization adsorbent. Upon detection, a sulfur capacity of the desulfurization adsorbent is 0.236, and its lifespan is only 3-4 h.

Comparative Example 3

A ZSM-5 type zeolite (without alkali treatment) and an active carbon (without alkali treatment) according to Example 5 are directly placed into a mortar and grounded after being blended at a weight ratio of 40:60, then placing the grounded material in an oven at a temperature of 120° C. to be dried for 6 h, thereby preparing a composite carrier.

The composite carrier is subjected to incipient wetness impregnation sequentially with a $K_2SO_4$ solution and a $NiSO_4$ solution according to the method described in Example 5, washing, drying and calcinating the impregnated material, thereby preparing a desulfurization adsorbent. Upon detection, a sulfur capacity of the desulfurization adsorbent is 0.155, and its lifespan is only 2-3 h.

Finally, it should be noted that the foregoing examples are merely intended for describing technical solutions of the present invention rather than limiting the present invention. Although the present invention is described in detail with reference to the foregoing examples, persons of ordinary skill in the art should understand that they may still make modifications to the technical solutions described in the foregoing examples, or make equivalent replacements to some or all technical features therein; however, these modifications or replacements do not make the essence of corresponding technical solutions depart from the scope of the technical solutions in the examples of the present invention.

What is claimed is:

1. A method for upgrading fluid catalytic cracking gasoline, consisting of steps of:

cutting fluid catalytic cracking gasoline into light, medium, and heavy gasoline fractions, wherein the medium gasoline fraction having a boiling range of 40-160° C. accounts for 40% of the fluid catalytic cracking gasoline, which has the lowest octane number, and has an RON below 80;

subjecting the medium gasoline fraction to an aromatization-hydroisomerization reaction in the presence of a catalyst to obtain a desulfurized medium gasoline fraction; and blending the light gasoline fraction, the desulfurized medium gasoline fraction and the heavy gasoline fraction to obtain upgraded gasoline;

wherein, a cutting temperature of the light and the medium gasoline fractions is 35-60° C., and a cutting temperature of the medium and the heavy gasoline fractions is 70-160° C.;

wherein the catalyst used for the aromatization-hydroisomerization reaction is obtained by using a zeolite and metallic oxide as a composite carrier to load an active metal component, wherein the active metal is gallium;

wherein the zeolite is an LTL type zeolite, and the metallic oxide is aluminum oxide.

2. The method for upgrading fluid catalytic cracking gasoline according to claim 1, wherein, in the catalyst used for the aromatization-hydroisomerization reaction, a weight ratio of the zeolite to the metallic oxide is 1:(0.2-0.5), and the active metal has a loading capacity of 0.5-3% on the composite carrier.

3. The method for upgrading fluid catalytic cracking gasoline according to claim 1, wherein a reaction temperature of the aromatization-hydroisomerization reaction is 260-400° C., a reaction pressure is 0.8-2.0 MPa, a volume ratio of hydrogen to oil is 200-800:1, and a weight hourly space velocity is 1.0-6.0 $h^{-1}$.

4. The method for upgrading fluid catalytic cracking gasoline according to claim 1, wherein, before cutting the fluid catalytic cracking gasoline into the light, the medium and the heavy gasoline fractions, the fluid catalytic cracking gasoline is subjected to sweetening treatment firstly.

5. A method for upgrading fluid catalytic cracking gasoline, consisting of steps of:

cutting fluid catalytic cracking gasoline into light, medium, and heavy gasoline fractions, wherein the medium gasoline fraction having a boiling range of 40-160° C. accounts for 40% of the fluid catalytic cracking gasoline, which has the lowest octane number, and has an RON below 80;

subjecting the medium gasoline fraction to desulfurization firstly to obtain a first desulfurized medium gasoline fraction, then subjecting the first desulfurized medium gasoline fraction to an aromatization-hydroisomerization reaction in the presence of a catalyst to obtain a second desulfurized medium gasoline fraction; and blending the light gasoline fraction, the second desulfurized medium gasoline fraction and the heavy gasoline fraction to obtain upgraded gasoline;

wherein, a cutting temperature of the light and the medium gasoline fractions is 35-60° C., and a cutting temperature of the medium and the heavy gasoline fractions is 70-160° C.;

wherein the catalyst used for the aromatization-hydroisomerization reaction is obtained by using a zeolite and metallic oxide as a composite carrier to load an active metal component, wherein the active metal is gallium;

wherein the zeolite is an LTL type zeolite, and the metallic oxide is aluminum oxide.

6. The method for upgrading fluid catalytic cracking gasoline according to claim 5, wherein the desulfurization of the medium gasoline fraction is solvent extraction desulfurization, and the solvent extraction desulfurization comprises the following steps: introducing the medium gasoline fraction from a middle lower part of an extraction tower and a solvent from a top of the extraction tower, injecting C5 paraffin from a backflow device at a bottom of the extraction tower, controlling a temperature at the top of the extraction tower between 55-100° C., a temperature at the bottom of the extraction tower between 40-80° C., and a pressure at the top of the extraction tower between 0.2-0.7 MPa, controlling a feed ratio of the solvent to the medium gasoline fraction between 1.0-5.0, and controlling a feed ratio of the C5 paraffin to the medium gasoline fraction between 0.1-0.5.

7. The method for upgrading fluid catalytic cracking gasoline according to claim 6, wherein the solvent is selected from one or more of diethylene glycol, triethylene glycol, tetraethylene glycol, dimethyl sulfoxide, sulfolane, N-formyl-morpholine, N-methyl pyrrolidone, polyethylene glycol and propylene carbonate.

8. The method for upgrading fluid catalytic cracking gasoline according to claim 5, wherein the desulfurization of the medium gasoline fraction is adsorption desulfurization, and the adsorption desulfurization is performed by using a desulfurization adsorbent, wherein the desulfurization adsorbent is obtained by using a zeolite and an active carbon that have been respectively subjected to alkali treatment as a composite carrier to load an active metal component, wherein the active metal is selected from one or more elements of groups IA, VIII, IB, IIB and VIB of a periodic table.

9. The method for upgrading fluid catalytic cracking gasoline according to claim 8, wherein, in the composite carrier of the desulfurization adsorbent, a weight ratio of the zeolite to the active carbon is (20-80): (80-20).

10. The method for upgrading fluid catalytic cracking gasoline according to claim 8, wherein the zeolite in the composite carrier of the desulfurization adsorbent is an X type, a Y type or a ZSM-5 type zeolite.

11. The method for upgrading fluid catalytic cracking gasoline according to claim 8, wherein the active metal in the desulfurization adsorbent is selected from at least two of Ni, Fe, Ag, Co, Mo, Zn and K.

12. The method for upgrading fluid catalytic cracking gasoline according to claim 8, wherein the active metal in the desulfurization adsorbent has a loading capacity of 2-30% on the composite carrier.

13. The method for upgrading fluid catalytic cracking gasoline according to claim 8, wherein the adsorption desulfurization is carried out by using a fixed bed at an atmospheric pressure, and a temperature for the adsorption desulfurization is controlled between 20-100° C., a flow rate of the medium gasoline fraction is 0.3-1 mL/min.

* * * * *